United States Patent [19]
Takahashi
[11] 4,443,923
[45] Apr. 24, 1984

[54] METHOD OF AND APPARATUS FOR MANUFACTURING A CONTINUOUS SLIDE FASTENER STRINGER CHAIN WITH ELEMENT-FREE SPACE PORTIONS

[75] Inventor: Kihei Takahashi, Uozu, Japan

[73] Assignee: Yoshida Kogyo K.K., Tokyo, Japan

[21] Appl. No.: 391,163

[22] Filed: Jun. 23, 1982

[30] Foreign Application Priority Data

Jun. 24, 1981 [JP] Japan ..... 56-93319

[51] Int. Cl.[3] ..... B21D 53/52; B21D 53/50; A41H 37/06

[52] U.S. Cl. ..... 29/408; 29/410; 29/33.2

[58] Field of Search ..... 29/33.2, 34 A, 408, 29/410, 766, 769

[56] References Cited

U.S. PATENT DOCUMENTS 3,225,430 12/1965 Fasciano ..... 29/408
3,470,133 1/1970 Glindmeyer et al. ..... 29/408
3,685,130 8/1972 Doerter ..... 29/408
3,812,573 5/1974 Fukouri ..... 29/410
4,232,438 11/1980 Takahashi et al. ..... 29/408
4,242,785 1/1981 Shimai ..... 29/408
4,404,722 9/1983 Shimai ..... 29/408

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of and apparatus for manufacturing a continuous slide fastener stringer chain including space portions devoid of coupling elements at longitudinal intervals. A pair of continuous stringer tapes is continuously fed, in synchronism with sewing machine, to a sewing area of the sewing machine, while a pair of interengaged rows of coupling elements is intermittently fed, in synchronism with the sewing machine, to the sewing area. A length of coupling elements is cut off from the pair of interengaged rows of continuous coupling elements each time the latter stops moving.

13 Claims, 10 Drawing Figures

METHOD OF AND APPARATUS FOR MANUFACTURING A CONTINUOUS SLIDE FASTENER STRINGER CHAIN WITH ELEMENT-FREE SPACE PORTIONS

BACKGROUND OF THE INVENTION

1. Field of the Invention

The present invention relates generally to the production of slide fasteners, and more particularly to a method of and apparatus for manufacturing a continuous slide fastener stringer chain including space portions devoid of coupling elements at longitudinal intervals.

2. Prior Art

According to a known method, a continuous slide fastener stringer chain having a pair of interengaged rows of continuous coupling elements sewn to a pair of continuous slide fastener stringer tapes along inner longitudinal edges, respectively, is intermittently fed in a longitudinal direction, and while the stringer chain is at rest, segments of coupling elements are cut off and removed to provide element-free space portions in the stringer chain at longitudinal intervals. With the known method, it has been observed that lines of stitching become slack at portions extending longitudinally across the element-free space portions with the result that endmost coupling elements, located next to the element-free space portions, are liable to be displaced. Such positionally unstable, endmost coupling elements hinder sliders from sliding thereover.

In another known method, a row of continuous coupling elements is intermittently supplied over one longitudinal edge of a continuous slide fastener stringer tape which is continuously fed to the sewing area of a sewing machine. The row of continuous coupling elements, while at rest, is severed into pieces of coupling elements to thereby produce element-free space portions between every adjacent pair of the pieces of coupling elements. Then the stringer tape is paired with a companion stringer tape into a continuous slide fastener stringer chain. The rows of coupling elements of severed length tend to be deformed or irregular in pitch under the influence of forces exerted thereon while they are fed before being coupled together, resulting in mismeshing of the coupling elements, particularly those coupling elements which are located next to the element-free space portions.

SUMMARY OF THE INVENTION

It is an object of the present invention to provide a method and apparatus which can manufacture a continuous slide fastener stringer chain including space portions devoid of coupling elements at longitudinal intervals, substantially at a single working station.

Another object of the present invention is to provide a method of and apparatus for manufacturing a continuous slide fastener stringer chain including space portions devoid of coupling elements at longitudinal intervals, in which endmost coupling elements adjacent to the space portions are fixed in position for allowing sliders to slide smoothly thereover.

Another object of the present invention is to provide a method of and apparatus for manufacturing a continuous slide fastener stringer chain, in which coupling elements are sewn to a pair of continuous slide fastener stringers along inner longitudinal edges, respectively, with uniform coupling element pitch.

Another object of the present invention is to provide a method and apparatus which can manufacture a continuous slide fastener stringer chain without causing mismeshing of coupling elements.

A pair of continuous slide fastener stringer tapes and a pair of interengaged rows of continuous coupling elements are introduced into a sewing area of a sewing machine such that the pair of interengaged rows of continuous coupling elements is held on inner longitudinal edges of the pair of stringer tapes, respectively. Then the sewing machine is driven to sew the pair of interengaged rows of continuous coupling elements to the pair of continuous slide fastener stringer tapes along the inner longitudinal edges, respectively. The slide fastener stringer tapes are continuously fed, in synchronism with said sewing machine, to the sewing area along a first longitudinal path, while the pair of interengaged coupling elements is intermittently fed, in synchronism with the sewing machine, to the sewing area along a second longitudinal path. A length of coupling elements then being sewn is cut off from the pair of interengaged rows of continuous coupling elements each time the latter stops moving. Thus, a continuous slide fastener stringer chain including sewn space portions devoid of coupling elements at longitudinal intervals is manufactured.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
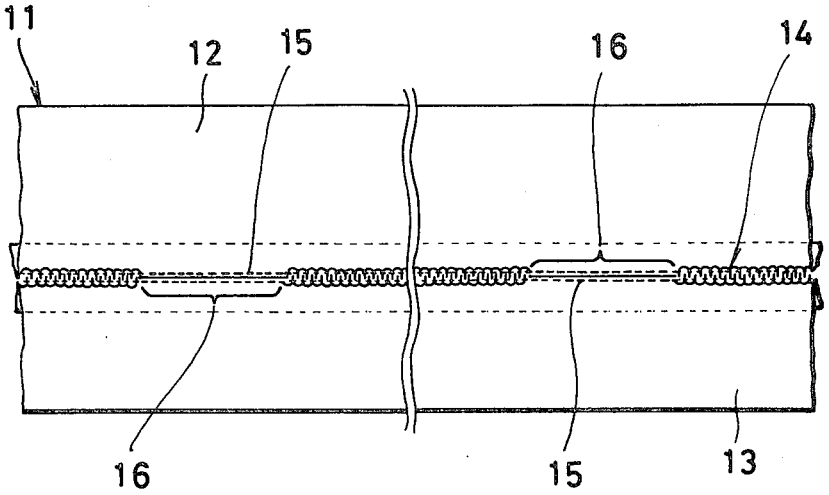
FIG. 1 is a fragmentary plan view of a continuous slide fastener stringer chain made according to the present invention.
Figure 2:
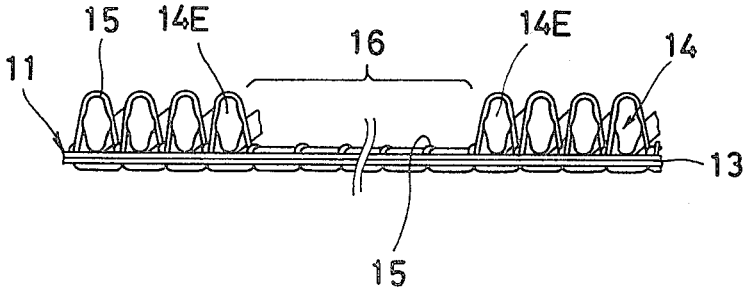
FIG. 2 is an enlarged front elevational view of a portion of the slide fastener stringer chain shown in FIG. 1.

As shown in FIGS. 1 and 2, a continuous slide fastener stringer chain 11 of the present invention comprises a pair of continuous slide fastener stringer tapes 12,13 and a series of longitudinally spaced pairs of interengaged rows of coupling elements 14 of individual lengths of slide fasteners secured to the stringer tapes 12,13 on and along respective doubled, inner longitudinal edges as by a pair of lines of stitching 15,15, there being space portions 16 devoid of coupling elements in the slide fastener stringer chain 10 at longitudinal intervals. As clearly shown in FIG. 2, the line of stitching 15 tightly stitches the stringer tape 13 longitudinally across the space portions 16 (only one shown). With this arrangement, even endmost coupling elements 14E (FIG. 2) adjacent to the space portion 16 are fixed in position and remain in substantially the same shape and pitch as the other continuous coupling elements 14, allowing a slider (not shown) to slide smoothly over the endmost coupling elements 14E.

Figure 3:
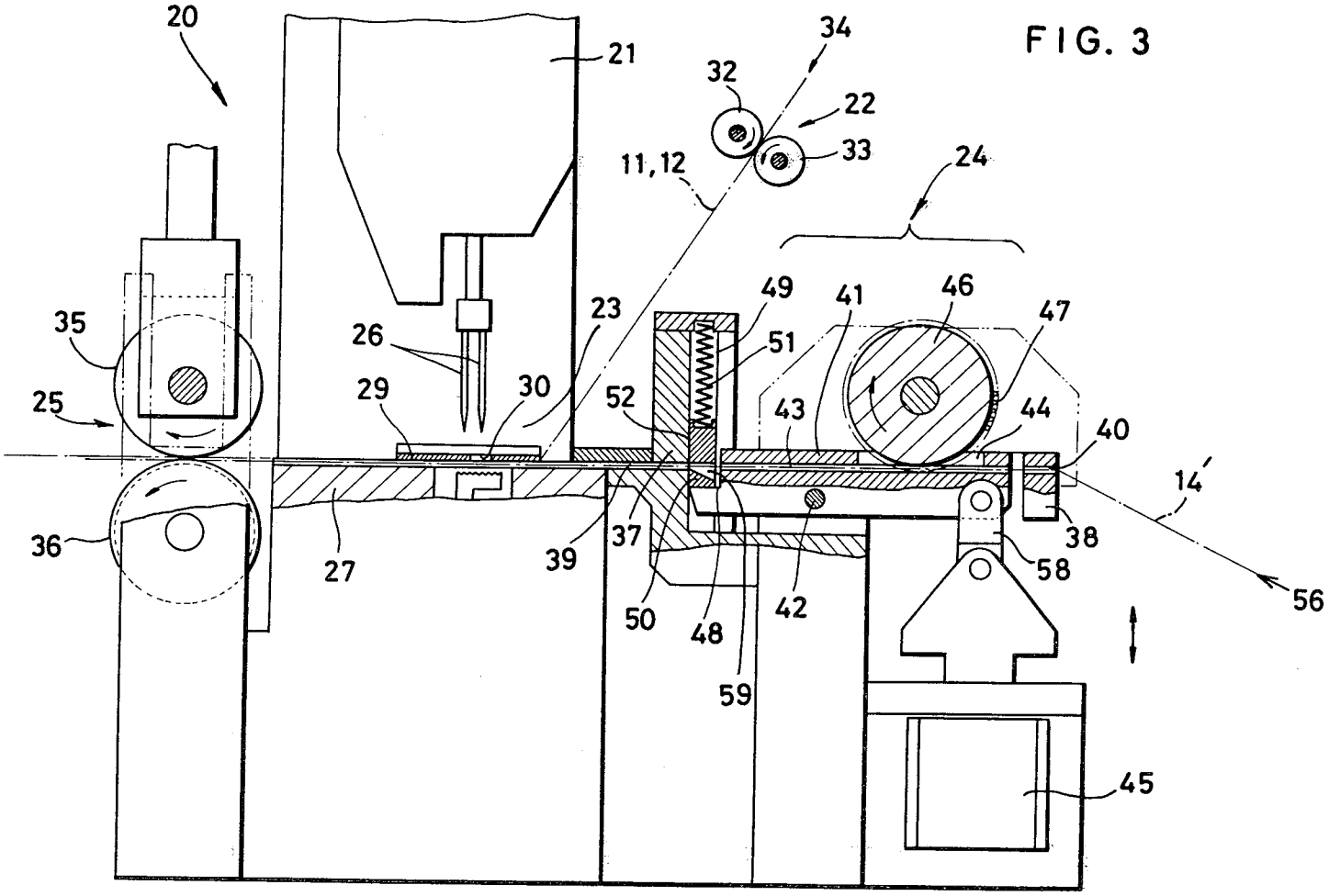
FIG. 3 is a fragmentary front elevational view, partly in cross section, of an apparatus according to the present invention.
Figure 4:
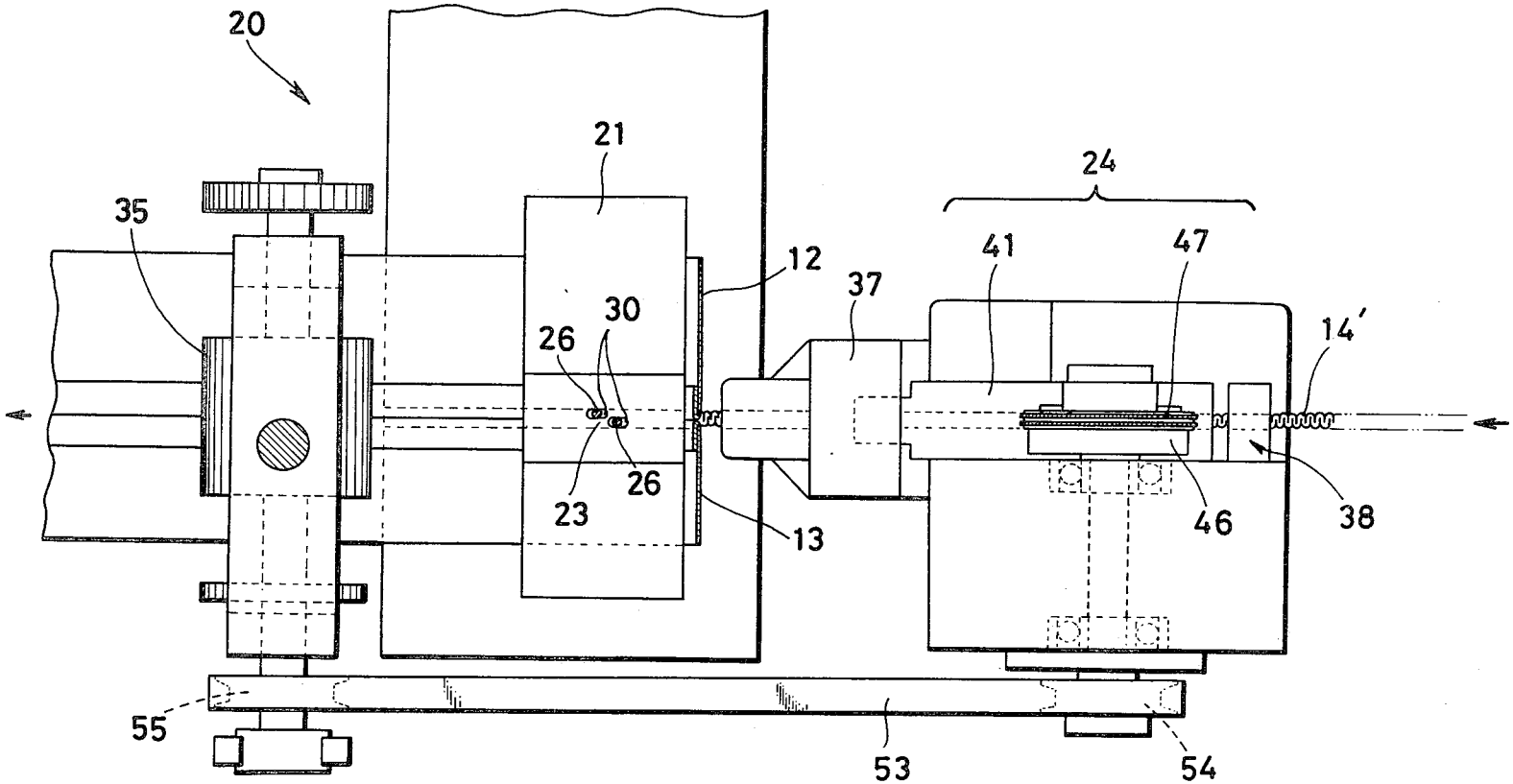
FIG. 4 is a fragmentary plan view of the apparatus shown in FIG. 3, the apparatus being partly omitted for clarity.

As shown in FIGS. 3 and 4, an apparatus 20 for manufacturing the slide fastener stringer chain 11 with the element-free space portions 16, generally comprises a sewing machine or mechanism 21, a feed means 22 for continuously feeding the pair of continuous slide fastener stringer tapes 12,13 to a sewing area or station 23, a combined feeding and cutting unit 24 for intermittently feeding a pair of interengaged rows of continuous coupling elements 14' to the sewing area 23, and for cutting off a length of coupling elements 14 from the continuous coupling elements 14', and a withdrawal means 25 for withdrawing the stringer tapes 12,13 from the sewing area 22.

Figure 9:
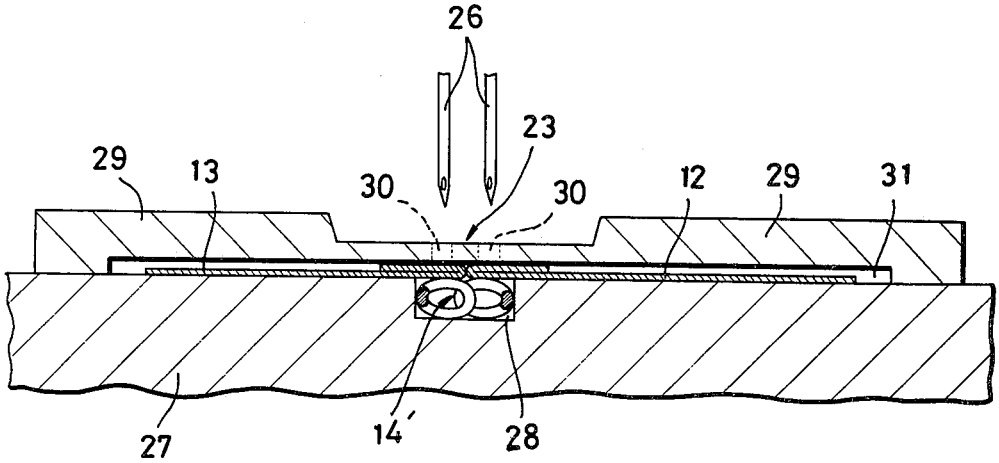
FIG. 9 is an enlarged, fragmentary transverse cross-sectional view of a sewing station of a sewing machine of the apparatus shown in FIG. 3.

The sewing machine 21 is a conventional two needle sewing machine and comprises a pair of needles 26,26 adapted to be driven to sew the interengaged rows of coupling elements 14 to the stringer tapes 12,13 along inner longitudinal edges, respectively. The sewing machine 21 includes a table 27 having a guide groove 28 (FIG. 9) extending longitudinally therethrough across the sewing area 23 for the passage therethrough of the coupling elements 14, and a guide plate 29 mounted on the table 27 and having a pair of needle holes 30,30 for the passage therethrough of the respective needles 26,26. The guide plate 29 further has a recess 31 (FIG. 9) for the passage therethrough of the stringer tapes 12,13.

The stringer tape feeding means 22 comprises a cooperating pair of drive and driven rollers 32,33 disposed upstream of the sewing machine 21. The drive roller 32 is rotatable in synchronism with the sewing machine 21 so as to continuously feed the stringer tapes 12,13 to the sewing area 23 of the sewing machine 21 along a first longitudinal path 34, the path 34 being inclined with respect to the plane of the table 27.

The stringer tape withdrawal means 25 comprises an adjustable drive roller 35 held in driving contact with a fixed, driven roller 36, the rollers 35,36 being disposed downstream of the sewing machine 21. The drive roller 35 is driven by a suitable driving means (not shown) to rotate in synchronism with the sewing machine 21 for continuously withdrawing the stringer tapes 12,13 from the sewing area 23 of the sewing machine 21.

The combined intermittently feeding and cutting unit 24 comprises a pair of spaced stationary guide members 37,38 disposed upstream of the sewing machine 21 and having respective guide grooves 39,40 extending in alignment with the guide groove 28 (FIG. 9) in the table 27 of the sewing machine 21, for the passage therethrough of the interengaged rows of coupling elements 14'. Disposed between the stationary guide members 37,38 is a guide lever 41 pivotably supported by a pivot pin 42 substantially at the center thereof and having a longitudinal guide channel 43 for the passage therethrough of the interengaged rows of coupling elements 14'. The guide lever 41 has a slot 44 opening to the guide channel 43 for the purpose described below.

Figure 5:
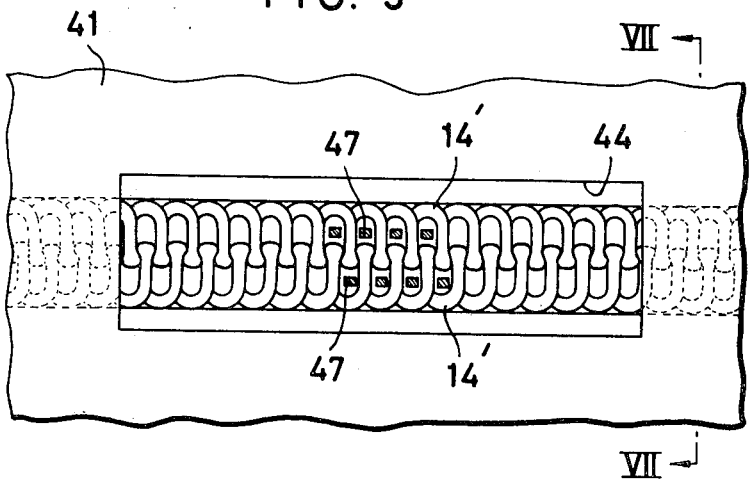
FIG. 5 is an enlarged fragmentary plan view of a coupling element feeding unit of the apparatus shown in FIG. 3, a toothed wheel of the feeding unit being omitted for clarity except showing several teeth thereof.
Figure 6:
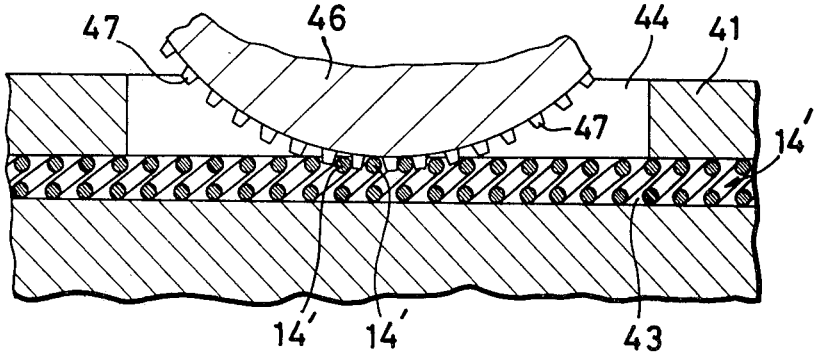
FIG. 6 is a longitudinal cross-sectional view of the feeding unit shown in FIG. 5, a peripheral portion of the toothed wheel being shown.
Figure 7:
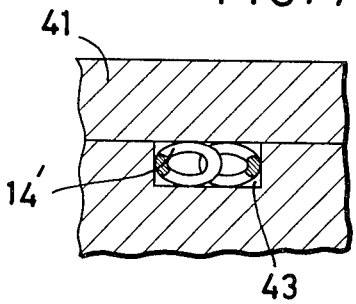
FIG. 7 is a fragmentary transverse cross-sectional view taken along the line VII—VII of FIG. 5.

A fixed axis, rotatable toothed member or wheel 46 is disposed above the guide lever 41 adjacent to the slot 44 thereof. The wheel 46 has a pair of rows of teeth or projections 47 arranged around the periphery thereof at equal intervals. Each tooth or projection 47 has a dimension enough to project into a space between every adjacent pair of coupling elements 14'. The guide lever 41 is connected at one end to a solenoid 45 via a link 58 and has a step 48 at the opposite end thereof. The guide lever 41 is normally held in a first or horizontal position shown in FIG. 3 in which the periphery and projections 47 of the wheel 46 extend through the slot 44 and into the guide channel 43 of the guide lever 41 so as to engage with and move the interengaged rows of coupling elements 14' along a second longitudinal path 56 upon rotation of the wheel 46, as best shown in FIGS. 5 and 6. As shown in FIG. 4, the toothed wheel 46 is driven in synchronism with the drive roller 35 of the withdrawal means 25 by means of a belt 56 which is trained around a pair of pulleys 54,55 connected respectively to the drive shafts of the wheel 46 and the drive roller 35.

Figure 8:
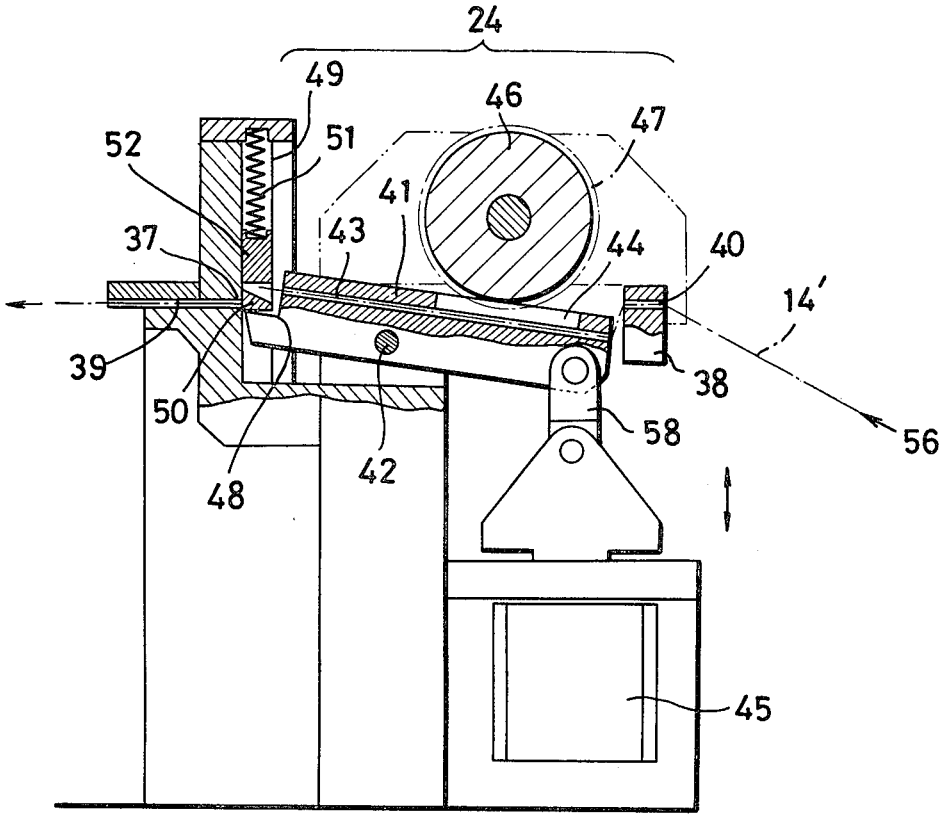
FIG. 8 is a front elevational view, partly in cross section, of a combined cutting and feeding unit of the apparatus shown in FIG. 3, parts of the unit being in a cutting position.

The combined feeding and cutting unit 24 further comprises a movable cutter 50 disposed between the guide lever 41 and the stationary guide member 37. The movable cutter 50 is slidably received in a slot 49 extending in the stationary guide member 37 transversely across the guide groove 39 and it is urged against the stepped end portion 48 of the guide lever 41, by a spring 51 acting between the cutter 50 and the guide member 37. The movable cutter 50 has a transverse slot 59 extending in alignment with the guide grooves 39,40 of the stationary guide members 37,38 and the guide channel 43 of the guide lever 41 when the guide lever 41 is held in the position of FIG. 3. The stationary guide member 37 has a die surface 52 extending transversely across the guide groove 39 for guiding the movable cutter 50 as the latter is moved upwardly along the die surface 52 across the longitudinal path 56 to cut the coupling elements 14', in response to the pivotal movement of the guide lever 41 toward a second or tilted position shown in FIG. 8 in which the guide lever 41 is held out of engagement with the toothed wheel 46.

In operation, the slide fastener stringer tapes 12,13 are introduced into the recess 31 in the sewing area 23 of the sewing machine 21 along the path 34, and the interengaged rows of coupling elements 14' are also introduced into the groove 28 in the sewing area 23 along the path 56 through the guide groove 40, through the guide channel 43, through the slot 59 and through the guide groove 39. In the sewing area 23, the rows of coupling elements 14' and the stringer tapes 12,13 are set in a position of FIG. 9 where the coupling elements 14' are held on doubled, inner longitudinal edges of the tapes.

Then the sewing machine 21 is driven to continuously sew the rows of coupling elements 14' to the stringer tapes 12,13 along respective longitudinal edges at a predetermined speed of sewing. Simultaneously therewith, the drive rollers 32,35 and the toothed wheel 46 are driven to rotate in the clockwise direction in FIG. 3 in synchronism with the sewing machine 21 so that the coupling elements 14' and the stringer tapes 12,13 are fed to the sewing area 23 at the same speed as the speed of the sewing, and the stringer tapes 12,13 with the coupling elements 14' sewn thereto are withdrawn from the sewing area 23 at the same speed as the speed of sewing. When a predetermined length of coupling elements 14' has been fed to the sewing area 23, the solenoid 45 is energized to actuate the guide lever 41 to pivotally move from the first, horizontal position of FIG. 3 to the second, tilted position of FIG. 8. Upon pivotal movement of the lever 41, the rows of coupling elements 14' are brought out of engagement with the projections 47 of the toothed wheel 46 and hence the feed of the coupling elements 14' is stopped. At the same time, the movable cutter 50 slidably moves upwardly along the die surface 52 across the rows of coupling elements 14' in the path 56 to cut off a length of coupling elements 14. With continued sewing of the sewing machine 21, the length of coupling elements 14 is introduced into the sewing area 23 and sewn to the stringer tapes 12,13 which are continuously fed to the sewing area 23 by the tape feed means 22. Upon the elapse of a predetermined interval of time, the solenoid 45 is deenergized to pivotally move or return the guide lever 41 from the tilted position of FIG. 8 to the horizontal position of FIG. 3. Upon pivotal movement of the guide lever 41, the rows of coupling elements 14' in the guide channel 43 are again brought into engagement with the projection 47 of the rotating toothed wheel 46 for being fed a predetermined distance to the sewing area 23. The foregoing cycle of operation is repeated to thereby produce the continuous slide fustener stringer chain 11 with element-free space portions 16 at longitudinal intervals, shown in FIGS. 1 and 2.

Figure 10:
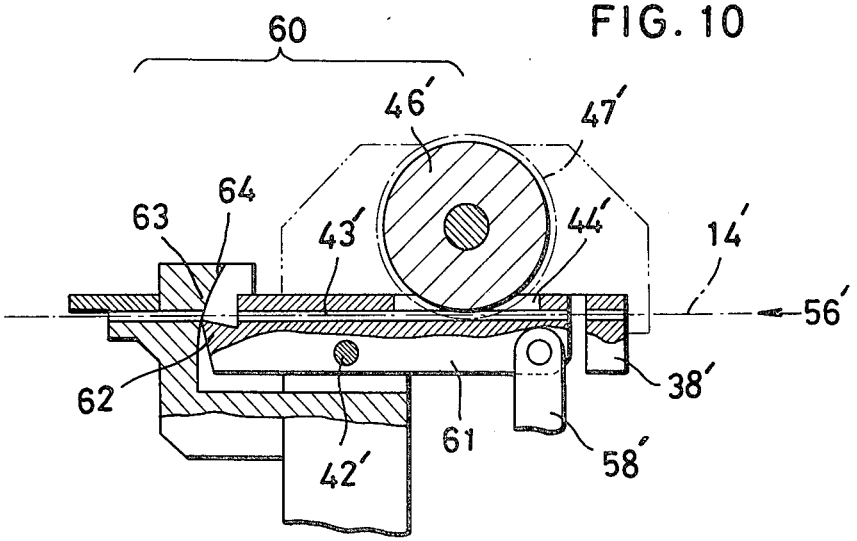
FIG. 10 appearing with FIG. 8, is a fragmentary front elevational view showing a modification of the invention.

The combined feeding and cutting unit 24 described above may be replaced with a modified unit 60 shown in FIG. 10. The unit 60 is substantially identical in construction and function to the unit 24 and hence similar parts are identified by similar primed reference numerals. According to the embodiment, a guide lever 61 has on one of its ends an integral cutting edge 62 slidable along an arcuate die surface 64 on a stationary guide member 63 for cutting off a length of coupling elements 14, in response to the pivotal movement of the guide lever 61.

With the method and apparatus of the present invention, the rows of coupling elements 14' fed and cut in interengaged fashion are resistant to deformation and remain in uniform element pitch, and the endmost coupling elements 14E adjacent element-free space positions 16 are fixed in position by the lines of stitching 15 extending tightly over the coupling element rows 14 longitudinally across the space portions 16 with the result that the sliders can be mounted smoothly on the rows of coupling elements 14 over the endmost coupling elements 14E. Further, the wasting of coupling elements at each space portion is eliminated.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of manufacturing a continuous slide fastener stringer chain including space portions devoid of coupling elements at longitudinal intervals, the method comprising the steps of:

(a) introducing a pair of continuous slide fastener stringer tapes and a pair of interengaged rows of continuous coupling elements into a sewing area of a sewing machine such that said pair of interengaged rows of continuous coupling elements is held on inner longitudinal edges of said pair of stringer tapes, respectively;

(b) continuously driving said sewing machine to sew said pair of interengaged rows of continuous coupling elements to said pair of continuous slide fastener stringer tapes along said inner longitudinal edges, respectively;

(c) continuously feeding said slide fastener stringer tapes, in synchronism with said sewing machine, to said sewing area along a first longitudinal path;

(d) intermittently feeding said pair of interengaged coupling elements, in synchronism with said sewing machine, to said sewing area along a second longitudinal path; and (e) cutting off a length of coupling elements then being sewn from said pair of interengaged rows of continuous coupling elements each time the latter stops moving.

2. A method according to claim 1, including the step of continuously withdrawing said pair of continuous slide fastener stringer tapes from said sewing area in synchronism with said sewing machine.

3. An apparatus for manufacturing a continuous slide fastener stringer chain including space portions devoid of coupling elements at longitudinal intervals, the apparatus comprising:

(a) a sewing machine continuously drivable to sew a pair of interengaged rows of continuous coupling elements to a pair of continuous slide fastener stringer tapes along inner longitudinal edges, respectively;

(b) means for continuously feeding said pair of continuous slide fastener stringer tapes, in synchronism with said sewing machine, to a sewing area of said sewing machine along a first longitudinal path; and (c) means for intermittently feeding said pair of interengaged rows of continuous coupling elements, in synchronism with said sewing machine, to said sewing area along a second longitudinal path, and for cutting off a length of coupling elements then being sewn from said pair of interengaged rows of continuous coupling elements each time the latter stops moving.

4. An apparatus according to claim 3, including means for continuously withdrawing said pair of continuous slide fastener stringer tapes from said sewing area in synchronism with said sewing machine.

5. An apparatus according to claim 3, said intermittently feeding and cutting means comprising a wheel rotatable in synchronism with said sewing machine and having on its periphery means for engaging and feeding said pair of interengaged rows of coupling elements, a pivotable lever having a longitudinal guide channel for the passage therethrough of said pair of interengaged rows of coupling elements and normally held in a first position where said engaging and feeding means partly project into said guide channel, said pivotable lever being movable from said first position to a second position where said engaging and feeding means are out of said guide channel, and a movable cutter disposed between said sewing area and said wheel and movable transversely across said second longitudinal path in response to the pivotal movement of said pivotable lever toward said second position.

6. An apparatus according to claim 5, including a pair of stationary guide member disposed one on each side of said pivotable lever and having respective guide grooves for the passage through of said pair of interengaged rows of coupling elements, said guide channel of said pivotable lever extending in alignment with said guide gooves while said pivotable lever is held in said first position.

7. An apparatus accoding to claim 6, said movable cutter being a separate element located between said pivotable lever and one of said stationary guide members, said pivotal lever having portions held in engagement with said movable cutter.

8. An apparatus according to claim 7, said one stationary guide member having a die surface extending transversely across said second longitudinal path, said movable cutter being slidable over said die surface in response to the pivotal movement of said movable lever toward said second position.

9. An apparatus according to claim 6, said movable cutter being integral with one end of said pivotable lever, one of said stationary guide members having a die surface extending transversely across said second longitudinal path, said movable cutter being slidable over said die surface in response to the pivotal movement of said movable lever toward said second position.

10. An apparatus according to claim 9, said die surface extending arcuately across said guide groove in said one stationary guide member.

11. An apparatus according to claim 5, including powered means for actuating said pivotable lever to pivotally move between said first and second positions.

12. An apparatus according to claim 11, said actuating means comprising a solenoid connected to said pivotable lever.

13. An apparatus according to claim 5, said engaging and feeding means on said wheel comprising at least one row of projections projecting into spaces between adjacent pair of coupling elements of each said row of coupling elements.

* * * * *